US012188130B2

(12) United States Patent
Roelofs et al.

(10) Patent No.: US 12,188,130 B2
(45) Date of Patent: Jan. 7, 2025

(54) ACID ZINC SULFATE METAL PRETREATMENT

(71) Applicant: Freiborne Industries, Inc., Pontiac, MI (US)

(72) Inventors: Robert R. Roelofs, Allen Park, MI (US); Jennifer Kim, Sterling Heights, MI (US)

(73) Assignee: Freiborne Industries, Inc., Pontiac, MI (US)

( * ) Notice: Subject to any disclaimer, the term of this patent is extended or adjusted under 35 U.S.C. 154(b) by 1347 days.

(21) Appl. No.: 16/518,113

(22) Filed: Jul. 22, 2019

(65) Prior Publication Data

US 2020/0024743 A1 Jan. 23, 2020

Related U.S. Application Data

(60) Provisional application No. 62/701,961, filed on Jul. 23, 2018.

(51) Int. Cl.

| | |
|---|---|
| ***C23C 22/48*** | (2006.01) |
| ***C23C 22/50*** | (2006.01) |
| ***C23C 22/52*** | (2006.01) |
| ***C23C 22/56*** | (2006.01) |
| *C23C 22/00* | (2006.01) |

(52) U.S. Cl.
CPC ..... *C23C 22/50* (2013.01); *C23C 22/52* (2013.01); *C23C 22/56* (2013.01)

(58) Field of Classification Search
None
See application file for complete search history.

(56) References Cited

U.S. PATENT DOCUMENTS

| | | | | |
|---|---|---|---|---|
| 2007/0089808 A1* | 4/2007 | Hashimoto | ..... | C23C 22/56 148/264 |
| 2009/0084682 A1 | 4/2009 | McMillen et al. | | |
| 2016/0024309 A1 | 1/2016 | Sondermann et al. | | |

FOREIGN PATENT DOCUMENTS

| | | | | |
|---|---|---|---|---|
| CN | 102586769 A | | 7/2012 | |
| GB | 1061436 | * | 3/1967 | ..... C23C 22/37 |
| JP | 2005-225923 A | | 2/2006 | |
| KR | 10-0553401 B1 | | 2/2006 | |
| KR | 10-1952624 | * | 2/2019 | ..... C23C 22/30 |

OTHER PUBLICATIONS

International Search Report and Written Opinion regarding related PCT/US2019/042905 mailed Nov. 8, 2019.

* cited by examiner

*Primary Examiner* — Lois L Zheng
(74) *Attorney, Agent, or Firm* — Dickinson Wright PLLC

(57) ABSTRACT

Disclosed is a phosphate-free aqueous acidic conversion coating comprising zinc sulfate and sulfuric acid. The conversion coating finds special use as a conversion coating to metal substrates prior to application of a cold forming lubricant or prior to application of a paint. The conversion coatings according to the present disclosure avoid the issues associated with phosphate containing conversion coatings but provide similar benefits to phosphate-based conversion coatings. Optional components of the conversion coating solutions include one or more of pH adjustment neutralizers, coating stabilizers, coating accelerators, coating refiners, etchants, paint adhesion promotors and mixtures thereof. In an additional option, manganese oxide can be used in place of zinc oxide.

20 Claims, No Drawings

ACID ZINC SULFATE METAL PRETREATMENT

CROSS-REFERENCE TO RELATED APPLICATIONS

This application claims the benefit of U.S. Provisional Application No. 62/701,961, filed on Jul. 23, 2018 and which is hereby incorporated by reference.

STATEMENT REGARDING FEDERALLY SPONSORED RESEARCH

NONE.

FIELD OF THE DISCLOSURE

This present disclosure relates generally to pretreatment solutions for metals, and more particularly to a phosphate-free sulfate-based zinc oxide treatment solution.

BACKGROUND OF THE DISCLOSURE

This section provides background information which is not necessarily prior art to the inventive concepts associated with the present disclosure.

In the field of metal working it is common to apply a lubricant coating to a metal prior to cold forming the metal. It has been common practice in the industry to first deposit a layer of microcrystalline zinc phosphate onto the metal surface prior to applying a lubricant coating onto the metal. The lubricants are typically polymeric in nature, oil based, or soaps of fatty acids, for example, sodium stearate.

Threaded bolt fasteners are often formed using a cold forming process. During cold forming the wire used to manufacture the bolts is first lubricated prior to the forming procedures. A popular layered lubricant coating for fasteners involves first depositing a zinc phosphate conversion coating onto the steel wire surface then applying a lubricant. The chemistry and surface structure of the phosphate coating is particularly advantageous to the integrity and performance of the sodium stearate or polymer based lubricant applied over it. Recently, the fastener industry has been looking for a lubricant process for cold forming that does not contain phosphate. Residual phosphate on the steel surface of the fastener is thought to cause hydrogen embrittlement in heated post forming operations used to harden the bolt. This condition is thought to reduce the strength of the bolt and cause premature failure of the fastener. Thus, there is a desire to develop a phosphate-free alternative to conventional zinc phosphate pretreatment technology to attempt to avoid this issue. In addition, many environmental regulatory agencies are regulating phosphate-containing compositions and a phosphate-free metal pretreatment could satisfy these new environmental regulatory requirements. Thus, there are some manufacturing operations be they cold forming or paint pretreatment that prefer phosphate free chemistry to meet their waste water regulatory requirements. Finally, there is a desire to improve the corrosion protection under paint in some applications compared to that provided by conventional zinc phosphate or transition metal pretreatments.

In summary, it is desirable to provide: phosphate-free alternatives to conventional zinc phosphate coatings used for cold forming technology to address phosphate induced hydrogen embrittlement of steel and steel fasteners; phosphate-free metal pretreatments to satisfy environmental regulatory requirements; and pretreatments that result in improved corrosion protection under paint.

SUMMARY OF THE DISCLOSURE

This section provides a general summary of the present disclosure and is not intended to be interpreted as a comprehensive disclosure of its full scope or all features, aspects and objectives.

A conversion coating composition according to the present disclosure is completely phosphate-free and comprises a mixture of sulfuric acid and zinc oxide in an aqueous solution with a pH of from 4.0 to 6.0. The conversion coating composition optionally includes one or more of: an application bath or solution pH adjustment neutralizer to maintain the pH in the range of 4.0 to 6.0; a concentrate stabilizer comprising nitric acid; a coating accelerator; a coating refiner; an etchant and a paint adhesion promotor. Preferably, the conversion coating application bath or solution comprises sulfuric acid, zinc oxide, nitric acid, an application bath or solution pH adjustment neutralizer, a coating accelerator and a coating refiner. Once applied to a substrate the conversion coating composition forms an actual coating comprising zinc sulfate on the surface of the substrate. This coating is highly beneficial in retaining lubricants used in cold forming processes and in adhering paint to the substrate.

These and other features and advantages of this disclosure will become more apparent to those skilled in the art from the detailed description herein. The drawings that accompany the detailed description are described below.

BRIEF DESCRIPTION OF THE DRAWINGS

None.

DETAILED DESCRIPTION OF THE DISCLOSURE

In the following description, details are set forth to provide an understanding of the present disclosure.

For clarity purposes, example aspects are discussed herein to convey the scope of the disclosure to those skilled in the relevant art. Numerous specific details are set forth such as examples of specific components, devices, and methods, in order to provide a thorough understanding of various aspects of the present disclosure. It will be apparent to those skilled in the art that specific details need not be discussed herein, such as well-known processes, well-known device structures, and well-known technologies, as they are already well understood by those skilled in the art, and that example embodiments may be embodied in many different forms and that neither should be construed to limit the scope of the disclosure.

The terminology used herein is for the purpose of describing particular example aspects only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The following abbreviations are used throughout the present specification and claims. The term "gram" is abbreviated as "gm"; the term "milligram" is abbreviated "mg"; the term "milliliter" is abbreviated as "ml"; the term "degrees Celsius" is abbreviated as "° C."; the term "degrees Fahrenheit" is abbreviated as "° F."; a "millimolar" concentration is abbreviated as "mM" and "parts per million" is abbreviated as "ppm".

The present coatings are known as conversion coatings in the art. The coatings are prepared as an application bath or solution that can be applied to a substrate by immersion in a bath, roller application or via a spray application. The coating solutions are aqueous and acidic. They are completely phosphate-free and comprise at least zinc oxide and sulfuric acid. The coatings, as will be described herein, also optionally include one or more of the following: pH adjustment neutralizers; coating concentrate stabilizers, coating accelerators, coating refiners, etchants and paint adhesion promotors. The coatings find use in coating a variety of metals including steel, carbon steel, galvanized steel, other steel alloys, aluminum, and aluminum alloys, brass and copper. In a typical process according to the present disclosure the substrate surface can be subjected to initial cleaning and degreasing steps if desired. Then, after water rinsing, the conversion coating according to the present disclosure is applied either by an immersion coating step, roller application or spray application. The immersion application is typically carried out for an exposure time of from 5 to 15 minutes and more preferably from 5 to 10 minutes. The spray application can be done for 30 to 90 seconds, more preferably for 60 to 90 seconds. Then the substrate is preferably rinsed with water, either city water or deionized water, to remove any coating solution that does not adhere prior to the next processing steps. The next processing steps can include application of at least one cold forming lubricant, painting, corrosion protection or any combination thereof.

The present conversion coating solution designs can be provided either as a concentrate that is diluted with water by the end user or it can be provided as a final bath. Most often the coating\chemistry is provided as a concentrate that the end user dilutes as required with water to form the final bath or spray solution. The dilution factor for the concentrate can be chosen to be any convenient dilution desired by the manufacturer. For example the concentrate could be a 10× or 20× concentrate. In the present disclosure, the final bath or spray coatings that are applied are completely phosphate-free acidic aqueous coating solutions having a pH of from 4.0 to 6.0, more preferably from 4.5 to 5.5. The pH of the coating solution is determined in part by the ratios of sulfuric acid and nitric acid to zinc oxide used and the amount of pH adjustment neutralizer used. The bath is formed initially and then the pH adjustment neutralizer is added as required to bring the pH to the desired level. In the present specification and claims, unless noted otherwise, the concentration of any component means its concentration in the application spray or bath as it is used and not its concentration in a formulation concentrate meant to be diluted by an end user.

The components of the conversion coating according to the present invention are preferably present in a final application bath or spray solution at the levels provided below in TABLE 1. The component levels are provided in terms of the mM concentration in the final aqueous coating solution. TABLE 1 provides a preferred range and most preferred range of each component in the final aqueous coating solution. Formula concentrates can be used to create an initial bath or coating solution and can also be used to replenish an existing bath as the components are depleted by coating substrates. Such replenisher usage of a concentrate is well known in the art.

TABLE 1

| COMPONENT | PREFERRED APPLICATION BATH RANGE (mM) | MOST PREFERRED APPLICATION BATH RANGE (mM) |
|---|---|---|
| $H_2SO_4$ | 25-100 | 50-75 |
| ZnO | 30-121 | 60-91 |
| pH Adjustment Neutralizer | Sufficient amount to maintain the bath or solution pH at 4.0 to 6.0 | Sufficient amount to maintain the bath or solution pH at 4.5 to 5.5 |
| Coating stabilizer solution, $HNO_3$ | 18-75 | 37-57 |
| Coating accelerator | 3-12 | 5-9 |
| Coating refiner | 1-10 | 3-7 |
| Etchant | 12-51 | 25-38 |
| Paint adhesion promotor | 0.5-2.0 | 0.75-1.5 |

The sulfuric acid in the conversion coating solution and application bath serves at least two purposes. It pickles a portion of the metal substrate thereby forming ions of the metal substrate, some of which are expected to be reincorporated into the coating. It also reacts with the zinc oxide and forms zinc sulfate which is deposited onto the metal substrate as part of the coating. The zinc sulfate has a low solubility in the acidic aqueous solution and is deposited by incipient precipitation from the conversion coating solution onto the substrate. The sulfuric acid is used in sufficient quantity to provide the proper pH and to form the zinc sulfate coating. Preferably, the sulfuric acid is present in the final bath at a level of from 25 to 100 mM, more preferably from 50 to 75 mM. The zinc sulfate, formed from the reaction of the zinc oxide with the sulfuric acid, provides a sacrificial barrier to corrosion, enhances paint adhesion and enhances the retention of lubricant coatings on the metal surfaces prior to a cold forming process. This is especially beneficial as the solutions according to the present disclosure are phosphate-free and still provide the benefits provided by use of zinc phosphate coatings. Zinc oxide is preferably present in the final bath at a level of from 30 to 121 mM, more preferably at a level of from 60 to 91 mM.

The preferred concentrated solution stabilizer is nitric acid, $HNO_3$, preferably the final level of nitric acid in the bath is from 18 to 75 mM, more preferably from 37 to 57 mM.

The exemplary pH adjustment neutralizers that can be used in the present disclosure include: NaOH, CaOH, MgOH, sodium carbonates, calcium carbonates and mixtures thereof. When the bath or solution is initially formed these are not added, instead they are added after the application bath or solution is formed to bring the pH to a level of from 4.0 to 6.0, more preferably from 4.5 to 5.5. The initially formed bath has a lower pH than preferred and this pH adjustment brings the bath into the preferred point of incipient precipitation.

A variety of coating accelerators can be utilized in the present conversion coating to aid in deposition of the coating. It is possible to formulate a coating according to the present invention without accelerators, however the accelerators increase the coating thickness and the speed of deposition, which is desirable. The preferred accelerator is hydroxylamine sulfate, $(NH_2OH)_2H_2SO_4$, but other accelerators used in conventional metal pretreatment applications, including by way of example only but not limited to, m-nitrobenzene sulfonate sodium salt, sodium nitrate, sodium chlorate, 3-aminobenzene sulfonic acid, and mixtures thereof can also be employed. Preferably the accelerators are used at a level of from 3 to 12 mM, more preferably from 5 to 9 mM.

A complete and uniform pretreatment coating is generally required to ensure the reliability of the ultimate layering system such as cold forming lubricants or paint. It has been found that the addition of trisodium salts of N-(2-hydroxyethyl)ethylenediamine-N,N',N' triacetic acid (HEDTA), available as Versenal™ 120 from Dow, a coating refiner, can significantly improve the coating deposition in the present disclosure. The coatings deposited with formulations that include HEDTA are more complete and heavier on the substrate compared to those produced using a bath that does not contain the coating helper. Examples of other coating refiners that can be used include, but are not limited to, sodium salts of L-glutamic acid, N,N-diacetic acid, nitrilotriacetic acid and mixtures thereof. The coating refiners are preferably in the bath at a concentration of from 1 to 10 mM, 3 to 7 mM.

The use of an etchant in the bath is very helpful in coating of aluminum or aluminum alloy substrates as they tend to form an aluminum oxide coating on the surface which should be removed. The aluminum etchant can be included in the bath and helps with deposition of the present coatings. Examples of etchants include but are not limited to those related to hydrofluoric acid and salts thereof including ammonium bifluoride (ABF) and tetrafluoroboric acid and mixtures thereof. They are preferably used at a level of from 12 to 51 mM, more preferably from 25 to 38 mM.

The bath also can include a paint adhesion promotor, especially if the surface is to be painted after the cold forming process. The paint adhesion promotors that can be used include, by way of example and not limitation, hexafluorosilicic acid; nitrates such as sodium nitrate, calcium nitrate, and nickel nitrate; sulfates such as copper sulfate or aluminum sulfate; hexafluorotitanic acid; hexafluorozirconic acid and mixtures of these promotors. The paint adhesion promotors are preferably used at a level of from 0.5 to 2.0 mM in the bath, more preferably from 0.75 to 1.5 mM.

The following examples are of coating solution formulations that were prepared and tested in accordance with the present disclosure. The baths were prepared by dissolving the components in the examples below in water to provide the final concentrations as listed in the example tables. After the bath was formed, the pH was then adjusted using the pH adjustment neutralizer to the desired range of from 5 to 5.5 and the baths were heated to the desired temperature. In most examples the temperature chosen was 180° F. and the bath exposure time was set at 10 minutes.

Example 1

| COMPONENT | Bath Concentration (mM) |
|---|---|
| $H_2SO_4$ | 65 |
| ZnO | 79 |
| $HNO_3$ | 49 |
| $(NH_2OH)_2 \bullet H_2SO_4$ (Hydroxylamine sulfate, accelerator) | 7.8 |
| N-(2-hydroxyethyl)ethylenediamine-N,N',N' triacetic acid (HEDTA, coating refiner) | 3.5 |

-continued

Example 2

| COMPONENT | Bath Concentration (mM) |
|---|---|
| $H_2SO_4$ | 65 |
| ZnO | 79 |
| $HNO_3$ | 49 |
| $(NH_2OH)_2 \bullet H_2SO_4$ (Hydroxylamine sulfate) | 7.8 |
| N-(2-hydroxyethyl)ethylenediamine-N,N',N' triacetic acid (HEDTA) | 3.5 |
| $NH_4HF_2$ Ammonium bifluoride, etchant | 33 |

Example 3

| COMPONENT | Bath Concentration (mM) |
|---|---|
| $H_2SO_4$ | 65 |
| ZnO | 79 |
| $HNO_3$ | 49 |
| $(NH_2OH)_2 \bullet H_2SO_4$ (Hydroxylamine sulfate) | 7.8 |
| N-(2-hydroxyethyl)ethylenediamine-N,N',N' triacetic acid (HEDTA) | 3.5 |
| $(H_3O)_2SiF_6$ Hexafluorosilicic acid, adhesion promotor | 1.27 |

As discussed herein, the present conversion coating solutions or baths are formulated to induce the point of incipient precipitation in the bath to create a zinc sulfate containing coating on a metal substrate being coated in the bath. Treatment bath conditions are intentionally created to encourage the dissolved constituents in the treatment bath to cooperatively precipitate in the form of crystals or as an amorphous solid on the metal surface. Sulfuric acid in the bath initially pickles the metal surface and dissolves the base metal into solution. It is expected that some portion of this dissolved metal will be redeposited and incorporated into the precipitated coating on the metal substrate. During use of the present bath a sulfate sludge is formed over time. In the coating process zinc oxide reacts with the sulfuric acid to form a soluble salt. The addition of nitric acid, a concentration stabilizer, to the bath is advantageous as it increases the stability of the concentrate formulations. The formula example concentrations of the components presented in Examples 1 to 3 are empirically based on coating deposition results that provide corrosion protection of an underlying substrate and that enhance the ability of the zinc sulfate coating complex to accept lubricants typically used in cold forming or paint coatings.

A conversion coating as recited in example 1 above was prepared and successfully utilized as a coating for steel substrates subsequently processed in a cold forming lubricant coating application. The coating according to example 1 provided adequate interim corrosion protection under the lubricant after the completion of the lubricant application process. The lubricant used was a reactive lubricant coating based on sodium stearate. A commercial example of such a lubricant is Formlube 1 from Freiborne Industries Inc (FII). The conversion coating according to example 1 has also been used successfully on steel substrates that were subsequently coated with an aqueous polymeric lubricant coating prior to a cold forming operation. Commercial examples of such aqueous polymeric lubricant coatings include Formlube 47 also available from Freiborne Industries Inc. The conversion coatings prepared according to the present disclosure permit the lubricants to wet out and fully cover the substrate surface. The conversion coatings according to the present disclosure hold the lubricants on the substrate surfaces during transportation and cold forming operations. The conversion coating of example 3 above was used to coat steel panels which were then coated with polyester and epoxy powder paint. These panels with paint films were single scribed and placed in an accelerated corrosion testing according to ASTM B117 for 500 hours and evaluated according to ASTM D1654. The results showed excellent corrosion creep protection. Over a 500 hour test the average creep was 0.5 mm with a range of from 0.25 to 2.0 mm. However, the paint adhesion loss at the paint pretreatment interface was not acceptable.

The conversion coating made according to example 1 above was modified in example 2 by the addition of the etchant ammonium bifluoride when being used to coat aluminum or aluminum alloy substrates. It was found that these substrates often had an outer coating of aluminum oxide, which the ammonium bifluoride successfully removed. Use of conversion coatings according to the present disclosure that included an etchant improved their performance on aluminum or aluminum alloy substrates. The aluminum oxide readily forms on these substrate surfaces and is often encountered as a solution barrier to the underlying native aluminum substrate. Other etchants like tetrafluoroboric acid are also able to attack this aluminum oxide film and can be used in the present conversion coatings.

A rinse with water, city water or deionized water, after application of the present conversion coating improves paint adhesion. The preferred method to increase paint adhesion after application the present conversion coatings, however, is to employ a paint adhesion promotor in the conversion coating. The paint adhesion promotors that find use in the present disclosure include, by way of example and not limitation: hexafluorosilicic acid, used in example 3; sodium nitrate; calcium nitrate; nickel nitrate; copper sulfate; aluminum sulfate; hexafluorotitanic acid and hexafluorozirconic. When used, the paint adhesion promotors are preferably present at levels of between 0.5 to 2.0 mM in the bath, more preferably from 0.75 to 1.5 mM. These promotors may be added directly to the concentrated formulas or side added to the bath.

The preferred bath or spray temperature according to the present disclosure is from 71 to 80° C. (160 to 180° F.). As the temperature is dropped to 160° F. the zinc sulfate coating develops a reddish color. Once the bath has been brought up to the desired temperature, the pH of the bath is adjusted to a pH of from 4 and 6, preferably from 4.5 to 5.5.

As discussed herein, a variety of pH adjustment neutralizers may be used to maintain the pH of the bath at the desired level including, for example: sodium hydroxide, calcium hydroxide, magnesium hydroxide, sodium carbonates and calcium carbonates. It has been observed that magnesium ions create a lighter colored conversion coating in contrast to calcium which is noticeably darker. Sodium ions impart a green hue to the coating. The pH of the bath effects the coating weight of the zinc sulfate deposited on the substrate surface. A series of baths were created using the conversion coating according to example 1 at different final pH levels. A series of steel substrates were immersed in each bath for the same period of time and the resulting deposited coating weight was measured. The results by pH and coating weight were as follows: a pH of 3.3 resulted in a coating weight of 104 mg/ft$^2$; a pH of 4.7 resulted in a coating weight of 130 mg/ft$^2$ and a pH of 5.0 resulted in a coating weight of 300 mg/ft$^2$. Thus, as shown by the results increasing the pH from 3.3 to 5.0 resulted in a significant increase in the rate of deposition of the coating according to the present disclosure. Preferably, the coating weight ranges from 100 to 400 mg/ft$^2$ on the metal substrate.

As an alternative to the above disclosed acid zinc sulfate conversion coating one can also use the present disclosure to prepare a manganese salt of sulfuric acid to create a manganese iron sulfate conversion coating. Heavy duty metal wear contact surfaces in machines or automotive applications such as differential gear boxes, power transmissions and pistons have been coated in the past with a manganese iron phosphate coating to serve as a "break-in coating" combined with oil to improve wear resistance. The present disclosure can be modified to substitute manganese oxide for the zinc oxide to create a manganese iron sulfate conversion coating. This manganese iron sulfate conversion coating can be used in place of the prior art manganese iron phosphate coating. Generally, speaking the application bath components that can be used are the same, however some ranges can be expanded and/or changed. For example the manganese iron sulfate conversion coating typically does not require as much coating stabilizer, for example $HNO_3$, or as much coating accelerator. The levels of manganese oxide can also be reduced compared to the amount of zinc oxide used above. One example conversion coating was prepared as described in Example 4 below. It was coated onto test plates by immersion at 80° C. for 20 minutes. The solution did not require any pH adjustment, it is typically below pH 4.0.

Example 4

| Component | Application bath concentration mM |
|---|---|
| H2SO4 | 28 |
| HNO3 | 2.6 |
| $(NH_2OH)_2 \cdot H_2SO_4$ (Hydroxylamine sulfate) | 0.15 |
| MnO | 7.4 |

The foregoing disclosure has been described in accordance with the relevant legal standards, thus the description is exemplary rather than limiting in nature. Variations and modifications to the disclosed embodiment may become apparent to those skilled in the art and do come within the scope of the disclosure. Accordingly, the scope of legal protection afforded this disclosure can only be determined by studying the following claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

We claim:

1. A phosphate-free aqueous acidic conversion coating solution for metal substrates comprising:

zinc oxide and sulfuric acid; and said conversion coating solution having a pH of from 4.0 to 6.0, a coating refiner in a positive amount of up to 10 mM, and optionally comprising one or more of a pH adjustment neutralizer in a positive amount, a coating concentrate stabilizer, a coating accelerator, an etchant, a paint adhesion promotor and mixtures thereof; and wherein the coating refiner is selected from the group consisting of a trisodium salt of N-(2-hydroxyethyl) ethylenediamine; N,N',N' triacetic acid; a sodium salt of L-glutamic acid; N,N-diacetic acid; nitrilotrisacetic acid; and mixtures thereof.

2. The phosphate-free aqueous acidic conversion coating solution according to claim 1 wherein the zinc oxide is present in an amount of from 30 to 121 mM.

3. The phosphate-free aqueous acidic conversion coating solution according to claim 1 wherein the sulfuric acid is present in an amount of from 25 to 100 mM.

4. The phosphate-free aqueous acidic conversion coating solution according to claim 1 wherein the coating concentrate stabilizer is present in a positive amount of up to 75 mM.

5. The phosphate-free aqueous acidic conversion coating solution according to claim 4 wherein said coating concentrate stabilizer comprises nitric acid.

6. The phosphate-free aqueous acidic conversion coating solution according to claim 1 wherein the etchant is present in a positive amount of up to 51 mM.

7. The phosphate-free aqueous acidic conversion coating solution according to claim 6 wherein the etchant is selected from the group consisting of hydrofluoric acid; salts of hydrofluoric acid; ammonium bifluoride; tetrafluoroboric acid; and mixtures thereof.

8. The phosphate-free aqueous acidic conversion coating solution according to claim 1 wherein the paint adhesion promotor is present in a positive amount of up to 2.0 mM in the solution.

9. The phosphate-free aqueous acidic conversion coating solution according to claim 8 wherein the paint adhesion promotor is selected from the group consisting of hexafluorosilicic acid; sodium nitrate; calcium nitrate; nickel nitrate; copper sulfate; aluminum sulfate; hexafluorotitanic acid; hexafluorozirconic acid; and mixtures thereof.

10. The phosphate-free aqueous acidic conversion coating solution according to claim 1 wherein the solution has a pH of from 4.5 to 5.5.

11. The phosphate-free aqueous acidic conversion coating solution according to claim 1 wherein the pH adjustment neutralizer is present in an amount sufficient to maintain the pH at from 4.0 to 6.0 and wherein the pH adjustment neutralizer is selected from the group consisting of sodium hydroxide; calcium hydroxide; magnesium hydroxide; a sodium carbonate; a calcium carbonate; and mixtures thereof.

12. A phosphate-free aqueous acidic conversion coating solution for metal substrates comprising:

zinc oxide and sulfuric acid;

said conversion coating solution having a pH of from 4.0 to 6.0, a coating refiner, at least one paint adhesion promoter in a positive amount, and optionally comprising one or more of a pH adjustment neutralizer, a coating concentrate, stabilizer, a coating accelerator, a coating refiner, an etchant, and mixtures thereof, and wherein the at least one adhesion promotor is present in an amount of from 0.5 to 2.0 mM and wherein the adhesion promotor is selected from the group consisting of hydroxylamine sulfate; m-nitrobenzene sulfonate sodium salt; sodium nitrate; sodium chlorate; 3-aminobenzene sulfonic acid; and mixtures thereof.

13. The phosphate-free aqueous acidic conversion coating solution according to claim 12 including in a positive amount a pH adjustment neutralizer, a coating accelerator, and a coating refiner.

14. The phosphate-free aqueous acidic conversion coating solution according to claim 12 wherein the zinc oxide is present in an amount of from 30 to 121 mM.

15. The phosphate-free aqueous acidic conversion coating solution according to claim 12 wherein the sulfuric acid is present in an amount of from 25 to 100 mM.

16. The phosphate-free aqueous acidic conversion coating solution according to claim 12 wherein the coating concentrate stabilizer is present in a positive amount of up to 75 mM.

17. The phosphate-free aqueous acidic conversion coating solution according to claim 16 wherein said coating concentrate stabilizer comprises nitric acid.

18. The phosphate-free aqueous acidic conversion coating solution according to claim 12 wherein the coating refiner is selected from the group consisting of a trisodium salt of N-(2-hydroxyethyl) ethylenediamine; N,N',N' triacetic acid; a sodium salt of L-glutamic acid; N,N-diacetic acid; nitrilotrisacetic acid; and mixtures thereof.

19. The phosphate-free aqueous acidic conversion coating solution according to claim 12 wherein the etchant is present in a positive amount of up to 51 mM.

20. The phosphate-free aqueous acidic conversion coating solution according to claim 19 wherein the etchant is selected from the group consisting of hydrofluoric acid; salts of hydrofluoric acid; ammonium bifluoride; tetrafluoroboric acid; and mixtures thereof.

* * * * *